United States Patent [19]

Schram

[11] Patent Number: 4,722,531

[45] Date of Patent: Feb. 2, 1988

[54] TAKE-DOWN ARROW

[76] Inventor: Donald E. Schram, 7240 W. Madison St., Forest Park, Ill. 60130

[21] Appl. No.: 412,864

[22] Filed: Aug. 30, 1982

[51] Int. Cl.[4] ..... F41B 5/02

[52] U.S. Cl. ..... 273/416; 403/343

[58] Field of Search ..... 273/416, 419, 423, 68, 273/80 R; 403/343, 299, 296

[56] References Cited

U.S. PATENT DOCUMENTS

| | | | |
|---|---|---|---|
| 192,718 | 7/1877 | Smith | 403/343 X |
| 1,145,127 | 7/1915 | Dunnebacke et al. | 273/68 |
| 2,834,625 | 5/1958 | Stanley et al. | 403/343 |
| 3,269,730 | 8/1966 | Miller et al. | 403/296 X |
| 3,368,271 | 2/1968 | Scheffler | 273/68 X |
| 3,495,123 | 2/1970 | Raddatz | 403/343 X |
| 3,759,519 | 9/1973 | Palma | 273/416 |
| 4,141,554 | 2/1979 | Sherwin | 273/421 X |
| 4,203,601 | 5/1980 | Simo | 273/421 |

FOREIGN PATENT DOCUMENTS

| | | | |
|---|---|---|---|
| 3250 | of 1915 | United Kingdom | 403/343 |

OTHER PUBLICATIONS

Archers Bible, 1966–1967, pp. 53–55.

Archery, 11–1978, Easton, "Klicka-Point".

*Primary Examiner*—Paul E. Shapiro

*Attorney, Agent, or Firm*—Thomas W. Speckman

[57] ABSTRACT

A take-down hollow shaft arrow assembly having a threadedly engageable insert portion affixed within each of two portions of a hollow arrow shaft enabling an arrow to be reduced to about half of its original length for transport or storage while retaining its original flight characteristics upon reassembly. The threadedly engaged insert abutable portions are axially spaced when the hollow arrow shaft ends firmly abut. At least one-third of the length of one of the inserts extends from one shaft portion and fits snugly into the other shaft portion. An alignment cylinder provides both accurate alignment and enhanced rigidity to the reassembled arrow shaft and resists bending of the arrow shaft upon impact with a hard object.

16 Claims, 3 Drawing Figures

TAKE-DOWN ARROW

BACKGROUND OF THE INVENTION

The usual methods of transporting and storing arrows require that arrows are packed in containers which accommodate their full length. Arrows packaged in this way are unwieldy to transport and frequently break. Hunters and backpackers experience difficulty in transporting arrows at their full length, the full length arrows impeding their progress through brush and in climbing. The take-down arrow of this invention has a fastening assembly which inserts into the central portion of a hollow arrow shaft allowing the arrow length to be reduced by about half for convenience in packing and traveling and then reassembled to its original length while providing a rigid, strong, aligned arrow shaft for shooting. Additionally, the take-down arrow of this invention facilitates exchange or repair of arrow sections in the field.

Various means of attachment of complementary units by threadable enagement are known to the art. For example, U.S. Pat. No. 713,334 discloses a joint in the central portion of a solid member fastened by placing a bolt in a cavity of one member, the bolt extending into the cavity of the other member to engage a nut. An important feature of the 713,334 patent is a washer which anchors the nut or bolt against turning. U.S. Pat. No. 2,868,602 teaches frusto-conical tapered furniture leg inserts with flutes to prevent turning which permanently and accurately positions a plurality of sections.

Various threadably attachable arrowheads and fletches have been described in the prior art. Exemplary threaded engagements for shaft and arrowhead attachment are taught by U.S. Pat. Nos. 3,401,938, 3,741,542, 3,945,642, 4,029,319, and exemplary threaded engagement for shaft and fletch attachment are taught by U.S. Pat. No. 4,266,782. U.S. Pat. No. 3,425,695 teaches threaded engagement for shaft and head attachment of a dart which also provides reinforcement of a hollow shaft. U.S. Pat. No. 4,141,554 teaches an arrow shaft internally threaded socket usable for attaching an arrowhead or fletch and for providing an arrow shaft extension. An important feature is providing adhesive attachment of the sockets at the open end of an arrow shaft without the adhesive flowing into the threaded portion.

Past attempts to create an arrow which may be disassembled and yet retains its original flight characteristics upon reassembly have been unsuccessful. Problems with proper alignment and satisfactory rigidity of the reassembled arrow have precluded widespread use. The arrow is prone, also, to bend at the junction of the sections when it strikes a hard, impenetrable object. The fastener assembly of the present invention joins the arrow sections in precise alignment, adds rigidity and strength to the arrow shaft and minimizes incidents of arrow shaft bending upon impact.

SUMMARY OF THE INVENTION

A take-down arrow is disclosed which facilitates the disassembly and reassembly of an arrow to permit greater convenience in transport or storage as well as exchange or repair of component arrow parts in the field. The take-down arrow of this invention has a forward shaft portion having an arrowhead attached to a first end and a hollow shaft portion at an opposite second end, the extremity of the forward shaft second end being in a plane at a right angle to the longitudinal axis of the forward shaft portion and a rearward shaft portion having a fletch attached to a first end and a hollow shaft portion at an opposite second end, the extremity of the rearward shaft second end being in a plane at a right angle to the longitudinal axis of the rearward shaft portion. An elongated fastening means has a first and a second threadedly engageable portion, each threadedly engageable portion having an outside diameter to fit snugly within the hollow shaft portions, the engaged length of the fastening means being at least 13 percent the length of the take-down arrow shaft, the first threadedly engageable portion is secured within the forward shaft hollow shaft portion and the second threadedly engageable portion is secured within the rearward shaft hollow shaft portion. The spacing of the threadedly engageable portions within the hollow shaft portions is such that when threadedly engaged the extremities of the forward and rearward shaft portions firmly abut each other and abutable portions of the fastening means are axially spaced and one of the threadedly engageable portions extends for at least one-third of its outside diameter length from one of the hollow shaft portions which extension fits snugly within the other of the hollow shaft portions. Generally, one of the fastening means portions is a male portion and the other a female portion. The positioning of each of the fastening means portions within the hollow arrow shaft is such that abutable portions of the fastening means are axially displaced when the forward and rearward hollow shaft extremities abut each other. The arrow shaft portions are consequently self-aligned and strengthened in their junction region and form a smooth, aligned, and strengthened arrow shaft. The engagement of the fastening means unites the arrow shaft portions so that the arrow retains its original flight characteristics and capability of withstanding impact.

It is an object of this invention to provide a take-down arrow which allows the arrow shaft to be disassembled, thereby reducing the length of an arrow for convenience in packing and transport and facilitating exchange or repair of damaged sections in the field.

It is another object of this invention to provide a take-down arrow which upon assembly accurately aligns arrow shaft sections and provides additional rigidity in the central portion of the arrow shaft.

It is a further object of this invention to provide a take-down arrow which reduces bending or breakage at a junction when the arrow strikes a hard object.

BRIEF DESCRIPTION OF THE DRAWING

The above and other objects and advantages of the present invention will become apparent to one skilled in the art upon reading the following disclosure and by reference to the drawing showing specific embodiments wherein.

DESCRIPTION OF PREFERRED EMBODIMENTS

Figure 1:
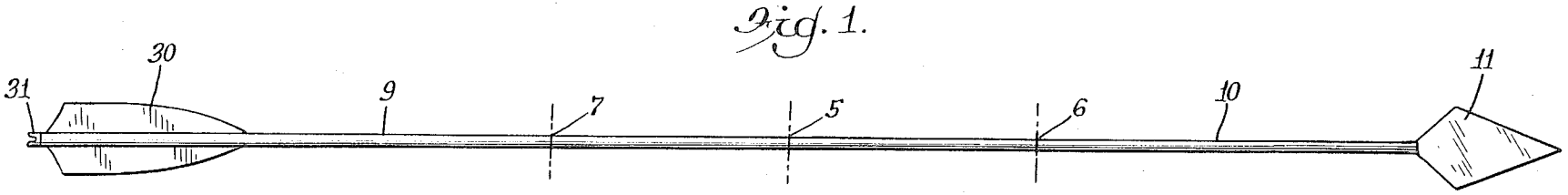
FIG. 1 shows a side view of an assembled take-down arrow of one embodiment of this invention.

The take-down arrow of this invention may have any type of hollow, cylindrical arrow shaft for insertion of the fastening means used in this invention. The arrow shown in FIG. 1 may have any type of arrowhead 11 attached to one end of a hollow arrow shaft and fletching 30 for guidance and nock 31 for the bow string at the other end. Hunting arrows conventionally made of an aluminum or fiberglass cylindrical shaft are well-suited for fabrication of take-down arrows according to this invention. For use in this invention, as shown in FIG. 1, the arrow shaft may be cut at its midpoint or fabricated in approximately equal sections to provide junction between forward shaft portion 10 and rearward shaft portion 9 at midpoint 5. It is suitable for the junction between forward shaft portion 10 and rearward shaft portion 9 to be at any location in the central third of the arrow shaft denoted by transverse planes 6 and 7. This range is most effective for transport and storage, the approximate equal length of the forward and rearward portions being preferred to provide the shortest length of take-down arrow components. By approximate equal lengths of forward and rearward portions, the projecting portion of the fastening means, to be described, and the arrowhead may be considered in arriving at equal length components. Because the arrowhead and the shaft near the arrowhead are more prone to breakage than other parts of the arrow, it may be more practical, for purposes of replacing broken arrow parts, to divide the arrow shaft between the midpoint 5 and the forward one-third point 6. Shafts with different arrowheads or fletchings may likewise be attached or substituted to provide greater versatility in arrow function.

Figure 2:
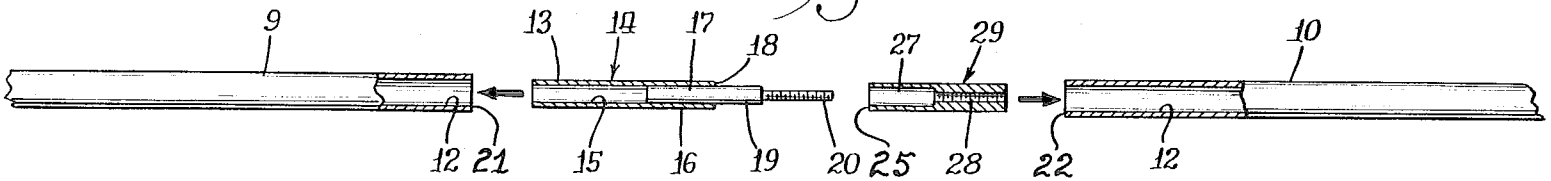
FIG. 2 shows an enlarged side, partially sectioned, exploded view of disassembled components of a take-down arrow of one embodiment of this invention.

FIG. 2 is an exploded view of the shaft junction portion and fastening means for one embodiment of a take-down arrow of this invention. The fastening means may be made of aluminum or any durable lightweight metal or reinforced synthetic polymer or combination of these materials. Aluminum is one preferred material. The fastening means comprises male unit 14 and a female unit 29 which threadably engage to join forward and rearward arrow shaft sections 10 and 9, respectively. The engaged length of the fastener means is at least 13 percent of the length of the arrow shaft. It is preferred that the length of the outside diameter of the fastening means fitting snugly with the hollow shaft be about 15 to 25 percent the length of the arrow shaft and, when assembled, be about equally within each the forward and rearward shaft portions 10 and 9, respectively. In this embodiment, the positioning of the fastening means within the arrow shaft allows the additional weight of the fastening means to be distributed evenly with respect to the midpoint of the arrow. Thus, the original flight characteristics of the arrow will be retained. In other embodiments, the weight may be distributed to the forward or rear of the midpoint thus altering flight characteristics as may be desired. It is one important feature of this invention that the fastening means be spaced within the hollow arrow shaft so that the extremities of the forward and rearward shaft portions firmly abut each other when the fastening means are engaged and abutable portions of the fastening means are axially spaced. When the fastening means are engaged, at least a third of the length of one of the fastening means portions extends from one of the hollow arrow shaft portions and its outside diameter fits snugly within the other of the hollow arrow shaft portions. This structure enhances self-alignment and rigidity of the asembled take-down arrow shaft.

Referring to FIG. 2, the male fastening unit 14 has threaded end portion 20, smooth shoulder portion 19, and cylindrical portion 13. The outer diameter of cylindrical portion 13 closely matches the inner surface 12 of arrow shaft 9 and 10. Male fastening unit 14 may be made of a tubular cylindrical portion 13 having inner diameter 15 for insertion of a solid threaded end portion 20 and smooth shoulder portion 19 with shoulder portion 17 fitting snugly within inner diameter 15. The construction of male fastening unit 14 in this fashion minimizes additional weight. In another embodiment it may be desired that male unit 14 add substantial weight to the arrow shaft so that a substantially heavier arrow would result from the substitution of one shaft unit for another. Male fastening unit 14 may then be made of solid metal along any portion of its length. In either embodiment, male fastening unit 14 may be fabricated from a single piece of material or assembled from multiple pieces. The length of threaded end portion 20 is sufficient to achieve good threadable engagement with female fastening unit 29. Smooth shoulder portion 19 may be eliminated, but in preferred embodiments is of sufficient length to provide additional alignment by engagement with a receiving cylinder in female fastening unit 29.

Female fastening unit 29 has a hollow receiving cylinder 27 corresponding to smooth shoulder portion 19 of male fastening unit 14. The remaining portion of the length has threads 28 to receive the corresponding threaded portion 20 of the male unit. The outer diameters of the male and female units are the same, and if the complementary units were to be threadably engaged to the point of abutment, the female unit end 25 would abut male unit shoulder 18 to form a smooth, continuous outer surface.

Male fastening unit 14 is securely fastened into either open end of forward shaft portion 10 or rearward shaft portion 9 so that approximately one-third of outside diameter length extends from the open end of the arrow shaft. The proportions of the male unit inserted within and extending from the arrow shaft may be varied to permit the desired weight distribution of the assembled shaft, thus retaining or altering original flight characteristics. The male fastening unit fits tightly within the arrow shaft and a length of cylindrical portion 13 is coated with a securement means, such as an adhesive, heat or air curable synthetic adhesive, or the like, and inserted to the desired depth within the arrow shaft. The adhesive is permitted to cure before the remainder of the fastening means is assembled.

Figure 3:
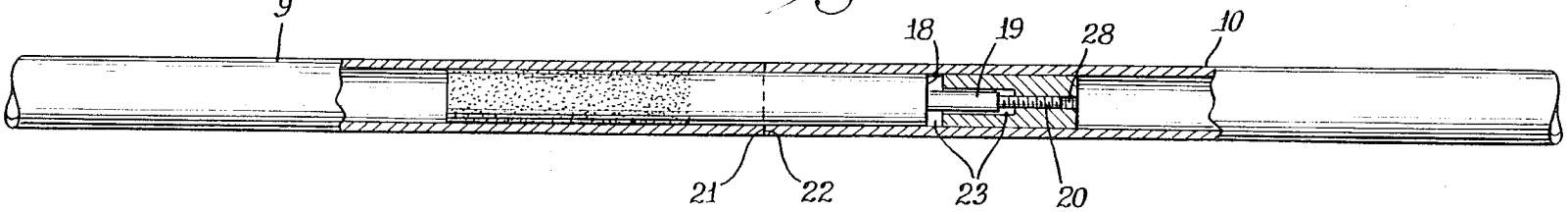
FIG. 3 shows an enlarged sectional view of assembled components of the take-down arrow shown in FIG. 2.

With male fastening unit 14 secured within one hollow shaft portion of the arrow shaft, female fastening unit 29 is threaded onto projecting threaded end 20 of the male unit. The fastening units are not engaged so far as to abut. An axial space of preferably about $\frac{1}{8}$ inch is left between abutable portions of the male fastening unit and the female fastening unit. As shown in FIG. 3, this axial space is between face 18 and face 25 and at the junction of shoulder 19 and threaded end 20. The female portion of the adapter it is coated with a securement means, such as an adhesive, while the outer surface of cylindrical portion 13 of male fastening unit 14 projecting from the arrow shaft is coated with a release agent or lubricant so that it will not be affected by the securement means. The female portion thus engaged to the projecting male portion is inserted into the opposite hollow shaft portion of the arrow shaft, and the arrow shaft reassembled so that the two shaft hollow portion extremities, each in a plane at a right angle to the longitudinal axis of the shaft firmly abut each other. The arrow shaft sections abut to form a smooth, continuous shaft length and may be maintained in firmly abuting relation by a jig or suitable holder while the adhesive is permitted to cure, securing the female fastening unit within the hollow shaft axially displaced from the open end of the arrow shaft. The arrow shaft may be disassembled by disengaging the threaded portion and the lubricant or release agent cleaned from the projecting cylindrical shaft portion 13 of the male fastening unit.

FIG. 3 shows the take-down arrow of FIG. 2 assembled for use. When assembled extremity 21 of rearward shaft portion 9 and extremity 22 of forward shaft portion 10 firmly abut each other while abutable portions 18 and 25 of the fastening means are axially spaced forming space 23. This is an important feature of the take-down arrow of this invention since coaction between firm abutment of the extremities of the arrow shaft portions in a plane at a right angle to their longitudinal axis and snug fitting of the outside diameter of at least one-third the length of one of the threadedly engageable fastening portions extending from one shaft portion into the other shaft portion assures self-alignment and lends additional rigidity and strength to the arrow in the central portion where the arrow shaft has the least intrinsic stability. The junction of the fastener assembly units according to this invention does not coincide with the junction of the arrow shaft portions and thereby reinforces the shaft at the junction of the shaft portions.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of the invention.

I claim:

1. A take-down arrow comprising:

a forward shaft portion having an arrowhead attached to a first end and a hollow shaft portion at an opposite second end, the extremity of said forward shaft second end being in a plane at a right angle to the longitudinal axis of said forward shaft portion;

a rearward shaft portion having a fletch attached to a first end and a hollow shaft portion at an opposite second end, the extremity of said rearward shaft second end being in a plane at a right angle to the longitudinal axis of said rearward shaft portion;

an elongated fastening insert comprising a first and a second threadedly engageable portion, each said threadedly engageable portion having an outside diameter to fit snugly within said hollow shaft portions, the engaged length of said fastening insert being at least 13 percent the combined length of said forward and rearward shaft portions, said first threadedly engageable portion secured within said forward shaft hollow shaft portion and said second threadedly engageable portion secured within said rearward shaft hollow shaft portion, the spacing of said threadedly engageable portions being such that when threadedly engaged the extremities of said forward and rearward shaft portions firmly abut each other and abutable portions of said fastening insert portions are axially spaced, and one of said threadedly engageable insert portions extends for at least one-third of its outside diameter length beyond said extremity of one of said hollow shaft portions, said extended portion fitting snugly within the other of said hollow shaft portions.

2. The take-down arrow of claim 1 wherein the engaged length of said fastening insert is about 15 to about 25 percent the length of the arrow shaft.

3. The take-down arrow of claim 1 wherein said forward and rearward shaft portions abut each other in the central one-third of the arrow shaft length.

4. The take-down arrow of claim 1 wherein one of said threadedly engageable portions comprises in sequence a male threaded end portion, a smooth shoulder portion, and a cylindrical portion, and the other of said threadedly engageable portions comprises a hollow receiving cylinder engageable with said smooth shoulder portion and a female threaded portion to threadedly engage said male threaded end portion, the outer diameter of said cylindrical portion of said one portion and the outer diameter of said other portion closely matches the inner surface of said hollow shaft portions.

5. The take-down arrow of claim 4 wherein said male threaded end portion and said smooth shoulder portion comprise one piece and said cylindrical portion comprises a second piece.

6. The take-down arrow of claim 4 wherein said one threadedly engageable portion comprises a single piece.

7. The take-down arrow of claim 1 or 4 wherein said axial space between said fastening insert abutable portions is about one-eight inch.

8. The take-down arrow of claim 1 or 4 wherein said one threadedly engageable portion extends about one-third to one-half of its outside diameter length from said one hollow shaft portion.

9. An assembled take-down hollow shaft arrow, said shaft having a forward portion having an arrowhead attached to a first end and a hollow shaft portion at an opposite second end, the extremity of said forward shaft second end being in a plane at a right angle to the longitudinal axis of said forward shaft portion and rearward shaft portion having a fletch attached to a first end and a hollow shaft portion at an opposite second end, the extremity of said rearward shaft second end being in a plane at a right angle to the longitudinal axis of said rearward shaft portion, a fastening insert joining said forward and rearward shaft portions and comprising a first and a second engaged portion, each said threadedly engaged portion having an outside diameter fitting snugly within said hollow shaft portions, the engaged length of said fastening insert being at least 13 percent the length of said take-down arrow shaft, said first threadedly engaged portion secured within said forward shaft hollow shaft portion and said second threadedly engaged portion secured within said rearward shaft hollow shaft portion, the extremities of said forward and rearward shaft portions firmly abutting each other and abutable portions of said fastening insert portions are axially spaced, and one of said threadedly engageable insert portions extending for at least one-third of its outside diameter length snugly into one of said hollow shaft portions in which it is not secured.

10. The assembled take-down arrow of claim 9 wherein the engaged length of said fastening insert is about 15 to about 25 percent the length of the arrow shaft.

11. The assembled take-down arrow of claim 9 wherein said forward and rearward shaft portions abut each other in the central one-third of the arrow shaft length.

12. The assembled take-down arrow of claim 9 wherein one of said threadedly engaged portions comprises in sequence a male threaded end portion, a smooth shoulder portion, and a cylindrical portion, and the other of said threadedly engaged portions comprises a hollow receiving cylinder engaged with said smooth shoulder portion and a female threaded portion threadedly engaged with said male threaded end portion, the outer diameter of said cylindrical portion of said one portion and the outer diameter of said other portion closely matches the inner surface of said hollow shaft portions.

13. The assembled take-down arrow of claim 12 wherein said male threaded end portion and said smooth shoulder portion comprise one piece and said cylindrical portion comprises a second piece.

14. The assembled take-down arrow of claim 12 wherein said one threadedly engageable portion comprises a single piece.

15. The assembled take-down arrow of claim 9 or 12 wherein said axial space between said fastening insert abutable portions is about one-eighth inch.

16. The assembled take-down arrow of claim 9 or 12 wherein said one threadedly engaged portion extends about one-third to one-half of its outside diameter length into said hollow shaft portion.

* * * * *